US008475001B2

(12) United States Patent
Wu et al.

(10) Patent No.: US 8,475,001 B2
(45) Date of Patent: Jul. 2, 2013

(54) LAMP AND LIGHT EMITTING DIODE TUBE THEREOF

(75) Inventors: Hsiang-Chen Wu, Taoyuan Hsien (TW); Chin-Ming Cheng, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 410 days.

(21) Appl. No.: 12/694,838

(22) Filed: Jan. 27, 2010

(65) Prior Publication Data

US 2011/0006702 A1 Jan. 13, 2011

(30) Foreign Application Priority Data

Jul. 13, 2009 (TW) ..... 98123569 A

(51) Int. Cl.
*F21V 27/00* (2006.01)
*F21V 14/00* (2006.01)

(52) U.S. Cl.
USPC ..... 362/258; 362/257

(58) Field of Classification Search
USPC ..... 315/291, 307, 224, 209 R, 246, 185 R, 315/185 S; 362/634, 97.2–97.4, 257, 258, 362/404, 407, 408, 429, 800
See application file for complete search history.

(56) References Cited

U.S. PATENT DOCUMENTS

| | | | | |
|---|---|---|---|---|
| 5,537,296 | A * | 7/1996 | Kimura et al. | 362/634 |
| 6,100,638 | A * | 8/2000 | Shah | 315/59 |
| 6,830,358 | B2 * | 12/2004 | Allen | 362/640 |
| 6,838,837 | B2 * | 1/2005 | Newsome | 315/307 |
| 6,984,984 | B2 * | 1/2006 | Frederick et al. | 324/414 |
| 7,053,557 | B2 * | 5/2006 | Cross et al. | 315/74 |
| 7,441,922 | B2 * | 10/2008 | Huang et al. | 362/235 |
| 2008/0013225 | A1 * | 1/2008 | Hung | 361/18 |

* cited by examiner

*Primary Examiner* — Minh D A
(74) *Attorney, Agent, or Firm* — Muncy, Geissler, Olds & Lowe, PLLC

(57) ABSTRACT

A lamp including a tube holder and a light emitting diode tube is disclosed. The tube holder includes a first terminal socket and a second terminal socket. The first terminal socket is electrically connected to a power source. The light emitting diode tube is installed onto the tube holder. One end of the light emitting diode tube has two first conductive terminals plugging in the first terminal socket so as to provide the power source to the light emitting diode tube. Alternatively, one end of the light emitting diode tube includes at least one first conductive terminal and the other end includes at least one second conductive terminal so as to conduct an alternate current power or a direct current power to the light emitting diode tube via the first conductive terminal and the second conductive terminal of two ends of the light emitting diode tube, respectively.

2 Claims, 8 Drawing Sheets

LAMP AND LIGHT EMITTING DIODE TUBE THEREOF

CROSS REFERENCE TO RELATED APPLICATIONS

This Non-provisional application claims priority under 35 U.S.C. §119(a) on Patent Application No(s). 098123569 filed in Taiwan, Republic of China on Jul. 13, 2009, the entire contents of which are hereby incorporated by reference.

BACKGROUND OF THE INVENTION

1. Field of Invention

The present invention relates to a lamp and a light emitting diode tube thereof. The lamp can be electrically connected to a power source via one end of the light emitting diode tube; otherwise, the lamp can be electrically connected to the power source via a first conductive terminal of one end of the light emitting diode tube and a second conductive terminal of the other end of the light emitting diode tube.

2. Related Art

FIG. 1A is a schematic view showing a connection configuration of a conventional fluorescent lamp. The fluorescent lamp 9 includes a fluorescent tube 92, a magnetic ballast 93 and a starter 94. For small fluorescent tubes, they do not require high voltage to start the lamp. However, for larger fluorescent tubes, they require a substantial high voltage (in the range of a thousand volts) to start the lamp. The starter 94 is used to preheat the electrodes of two ends of the fluorescent tube 92. When starting the lamp, a glow discharge will appear over the electrodes of the starter. This glow discharge will heat the gas in the starter and cause the bi-metallic electrode of the starter to bend towards the other electrode. When the electrodes touch, the two filaments 95 of the fluorescent lamp and the ballast will effectively be switched in series to the supply voltage. This causes the filaments to glow and emit electrons into the gas column by thermal ion emission. Once the tube is struck, the impinging main discharge then keeps the cathode hot, permitting continued emission without the need for the starter to close. The starter does not close again because the voltage across the starter is reduced by the resistance in the cathodes and ballast. The glow discharge in the starter will not happen at the lower voltage so it will not warm and thus close the starter. Tube strike is reliable in these systems, but glow starters will often cycle a few times before letting the tube stay lit, which causes undesirable flashing during starting.

Light emitting diodes have many advantages such as saving electricity and protecting environment, and are used to replace conventional lighting devices to be the major light source in the future. FIG. 1B is a schematic view showing a connection configuration of a conventional light emitting diode lamp 8 adapted from the fluorescent lamp 9 in FIG. 1A. In the light emitting diode lamp 8, the starter 94 will be removed, and the magnetic ballast 93 will be kept for lighting on the light emitting diode tube 82.

SUMMARY OF THE INVENTION

In view of foregoing, the present invention is to provide a lamp and a light emitting diode tube thereof. In the present invention, two first conductive terminals at one end of the light emitting diode tube are responsible for providing the current from a power source to the light emitting diode tube. Therefore, even if the light emitting diode tube is unconsciously installed onto the conventional fluorescent tube holder, the current can not flow through the lamp so that the safety can be enhanced.

The present invention is also to provide a lamp and a light emitting diode tube thereof that allow a direct current power or an alternative current power to be conducted to the light emitting diode tube through its two ends.

The present invention is further to provide a light emitting diode tube that can be installed onto a conventional fluorescent lamp without a starter.

To achieve above, the present invention discloses a light emitting diode tube to be installed onto a tube holder. The light emitting diode tube includes a light emitting diode module and two first conductive terminals. The light emitting diode module includes at least one light emitting diode string. The two first conductive terminals are disposed at one end of the light emitting diode module, and are electrically connected to a power source to drive the light emitting diode strings. Alternatively, one first conductive terminal and one second conductive terminal are disposed at different ends of the light emitting diode module, respectively, and are electrically connected to a power source to drive the light emitting diode strings.

To achieve above, the present invention also discloses a lamp including a tube holder and a light emitting diode tube. The tube holder includes a first terminal socket and a second terminal socket, and the first terminal socket is electrically connected to a power source. The light emitting diode tube is installed onto the tube holder, and one end of the light emitting diode tube has two first conductive terminals plugging into the first terminal socket so that the power source can be applied through one end of the light emitting diode tube. Alternatively, a first conductive terminal and a second conductive terminal are disposed at two ends of the light emitting diode module, respectively, and electrically connected to a power source to drive the light emitting diode strings.

As mentioned above, the present invention provides types of lamps and light emitting diode tubes thereof. The light emitting diode tube is electrically connected to a power source through its one end. Therefore, when the light emitting diode tube is unconsciously installed onto a conventional lamp, the light emitting diode tube can not be lighted. Because the light emitting diode tube is electrically connected to the power source via two terminals of the first lamp cap mounted on one end of the light emitting diode tube, the safety can be enhanced.

The present invention also provides types of lamps and light emitting diode tubes thereof. The light emitting diode tube includes at least one first conductive terminal and at least one second conductive terminal. The first conductive terminal and the second conductive terminal conduct a direct current power or an alternative current power to the light emitting diode tube.

The present invention further provides a light emitting diode tube installed onto a conventional fluorescent lamp without a starter.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

First Embodiment

Figure 2A:
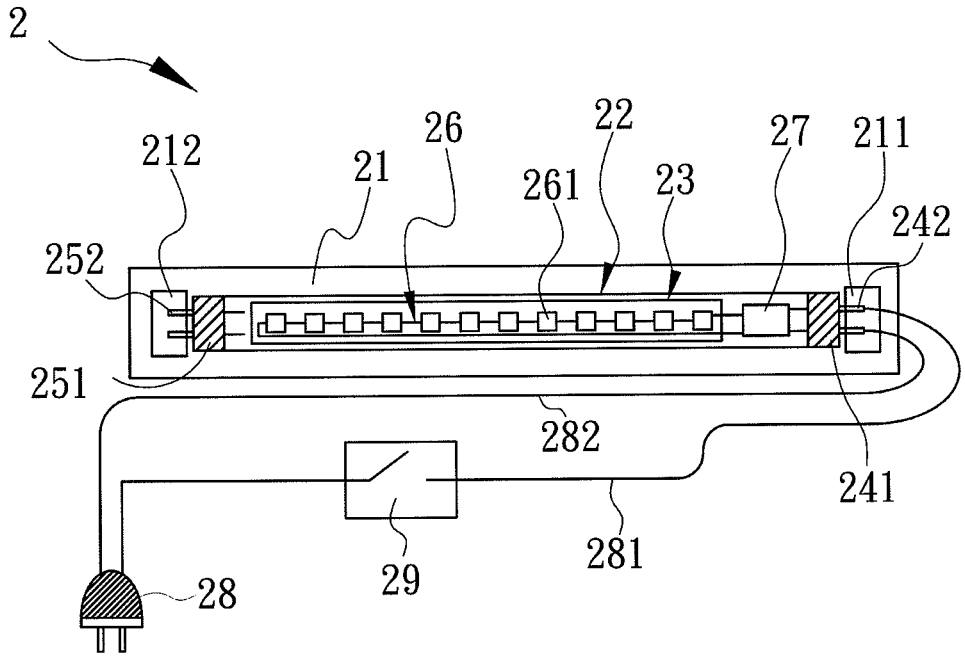
FIG. 2A is a schematic view of a lamp according to a first embodiment of the present invention.

FIG. 2A is a schematic view of a lamp 2 according to a first embodiment of the present invention. The lamp 2 mainly includes a tube holder 21 and a light emitting diode tube 22.

Figure 3A:
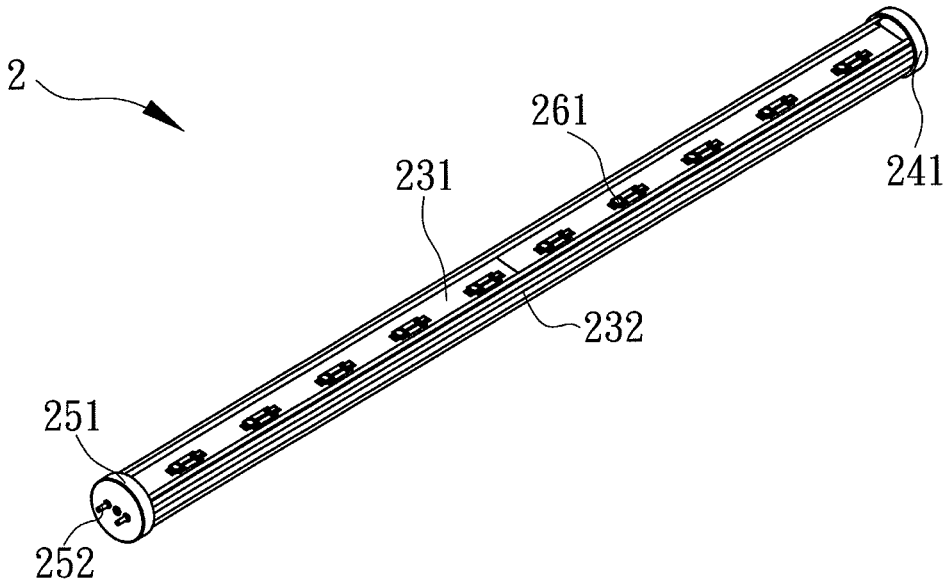
FIG. 3A is a perspective view of a light emitting diode tube according to the first embodiment of the present invention.
Figure 3B:
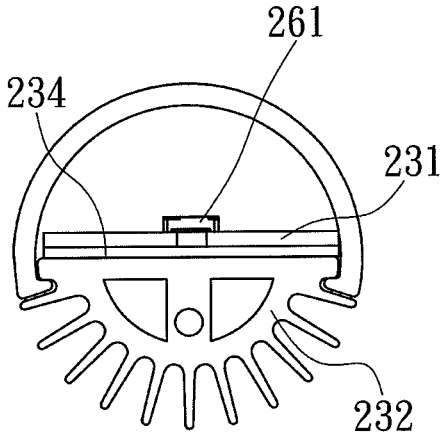
FIG. 3B is a cross-sectional view of the light emitting diode tube in FIG. 3A.

As shown in FIG. 2A, the tube holder 21 includes a first terminal socket 211 and a second terminal socket 212. The first terminal socket 211 is electrically connected to an alternative-current power source, and the second terminal socket 212 is not electrically connected to any power source. The light emitting diode tube 22 is installed onto the tube holder 21. FIG. 3A is a perspective view of a light emitting diode tube according to the first embodiment of the present invention. FIG. 3B is a cross-sectional view of the light emitting diode tube in FIG. 3A. With reference to FIGS. 2A, 3A and 3B, the light emitting diode tube 22 includes a light emitting diode module 23, a first lamp cap 241 and two first conductive terminals 242. The first lamp cap 241 is mounted on one end of the light emitting diode module 23. The two first conductive terminals 242 are disposed on the first lamp cap 241 and plug in the first terminal socket 211. The light emitting diode tube 22 is electrically connected to a power source through its one end.

Figure 4:
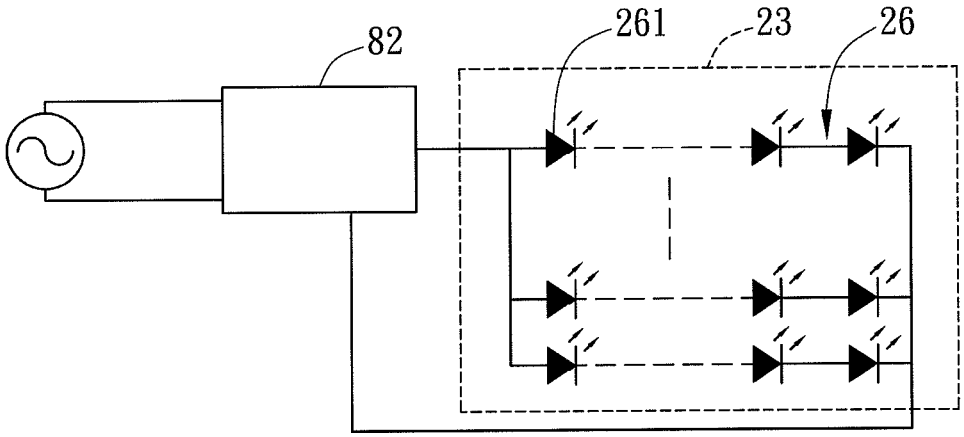
FIG. 4 is a schematic view showing the circuit of the light emitting diode tube according to the first embodiment of the present invention.

The light emitting diode module 23 mainly includes a substrate 231 and at least one light emitting diode string 26. The light emitting diode string 26 is formed by connecting a plurality of light emitting diodes 261 in series, and disposed on one surface of the substrate 231. Although the light emitting diode tube 22 is only illustrated with a single light emitting diode string 26 in all of the views in the embodiments of the present invention, it is just exemplary and not to limit the scope of the present invention. FIG. 4 is a schematic view showing the circuit of the light emitting diode tube according to the first embodiment of the present invention. As shown in FIG. 4, if the light emitting diode module 23 includes a plurality of light emitting diode strings 26, the light emitting diode strings 26 are connected in parallel.

The substrate 231 includes an insulation substrate and a first printed circuit formed on the insulation substrate (not shown). The insulation substrate can be a glass fiber film FR-4.

The light emitting diode module 23 can further include a heat sink 232 disposed on the other surface of the substrate 231. The heat sink 232 is manufactured by way of aluminum extrusion or casting formation, or is assembled by a number of heat fins, and the material of the heat sink 232 can be copper, aluminum, iron, magnesium alloy, metal or a material with good thermal conductivity. The light emitting diode tube 22 can further include an insulation thermo-conductive tape 234 disposed between the substrate 231 and the heat sink 232 to adhere the substrate 231 with the heat sink 232 firmly.

The light emitting diode tube 22 further includes a second lamp cap 251 mounted on the other end of the light emitting diode module 23. The light emitting diode tube 22 can further include two insulation terminals, which may, for example but not limited to, be integrally formed with the second lamp cap 251 as one piece and plug in the second terminal socket 212. Alternatively, the light emitting diode tube 22 can further include two second conductive terminals 252, which are disposed on the second lamp cap 251 and plug in the second terminal socket 212. The two second conductive terminals 232 are electrically floating.

The light emitting diode tube 22 can further include a driving unit 27 disposed between the light emitting diode module 23 and the first conductive terminals 242. Preferably, the driving unit 27 is an alternative current to direct current converter. One of the first conductive terminals 242 is electrically connected to a Line wire, and the other one of the first conductive terminals 242 is electrically connected to a Neutral wire. The driving unit 27 can convert the alternative current power to the direct current power to drive at least one light emitting diode string 26 in the light emitting diode module 23.

The lamp 2 can further include a plug 28 electrically connected to an alternative current power source. The lamp 2 also can further include two conductive lines. One end of each of the conductive lines is connected to the plug 28, and the other end of each of the conductive lines is electrically connected to the first terminal socket 211. Thus, the other ends of the conductive lines are electrically connected to two first conductive terminals 242, respectively. In more detailed, the two conductive lines are composed by a first conductive line 281 and a second conductive line 282. One end of the first conductive line 281 and one end of the second conductive line 282 are electrically connected to the plug 28, and the other ends thereof are connected to the first terminal socket 211 to electrically connect the first conductive line 281 and the second conductive line 282 to the two first conductive terminals 242, respectively.

The lamp 2 further includes a switch 29 disposed on the first conductive line 281 or the second conductive line 282. The switch 29 is used to control an on/off state of the alternative current power source. As shown in FIG. 2A, the switch 29 is disposed on, for example but not limited to, the first conductive line 281.

Figure 2B:
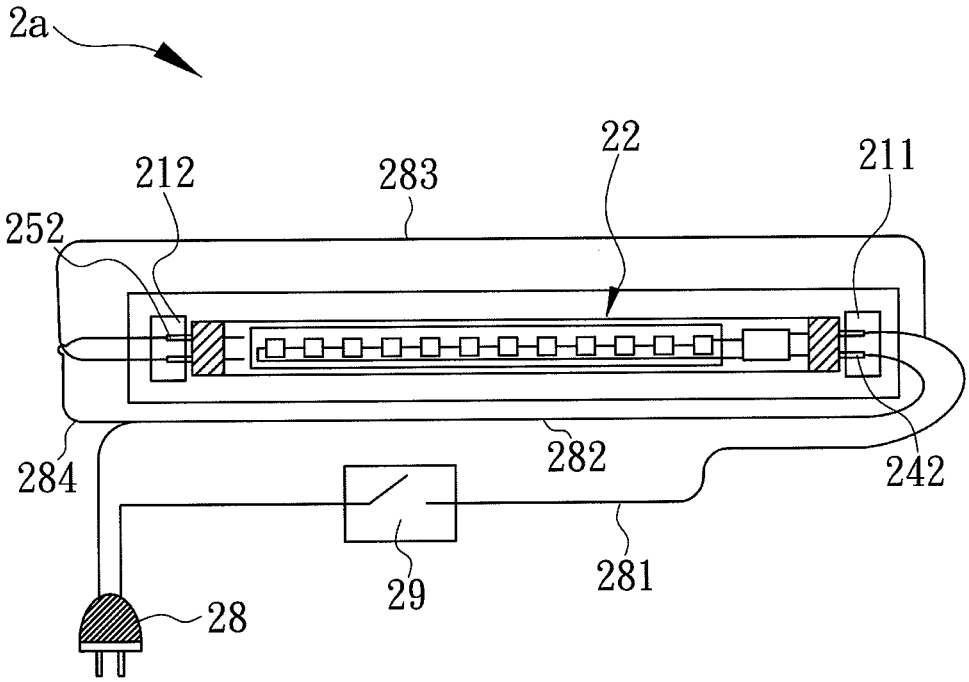
FIG. 2B is a schematic view of another variation of the lamp in FIG. 2A.

FIG. 2B is a schematic view of another variation of the lamp in FIG. 2A. The lamp **2*a* further includes two conductive lines connected to the second terminal socket 212 for conducting the current from the alternative current power source to the second terminal socket 212. In more detailed, the two conductive lines are composed by a third conductive line 283 and a fourth conductive line 284. One end of the third conductive line 283 is electrically connected to the first conductive line 281, and the other end thereof is connected to the second terminal socket 212. One end of the fourth conductive lines 284 is electrically connected to the second conductive line 282, and the other end thereof is connected to the second terminal socket 212. Accordingly, the second terminal socket 212 can be electrically connected to the same alternative current power source, so that the two first conductive terminals 242 of the light emitting diode tube 22 can be electrically connected to the alternative current power source via the first terminal socket 211 or the second terminal socket 212. In this case, one of the first conductive terminals 242 is electrically connected to the Line wire, and the other one of the first conductive terminals 242 is electrically connected to the Neutral line. This may increase the flexibility for installing the light emitting diode tube 22. As shown in FIG. 2B, the described electrical connection of the third conductive line 283 and the fourth conductive line 284 of the lamp 2***a* is for illustrations only and is not to limit the scope of the present invention. Besides, because the power source is an alternative power source, the two second conductive terminals 252 can be interchangeably connected to the third conductive line 283 and the fourth conductive line 284, respectively.

Figure 1A:
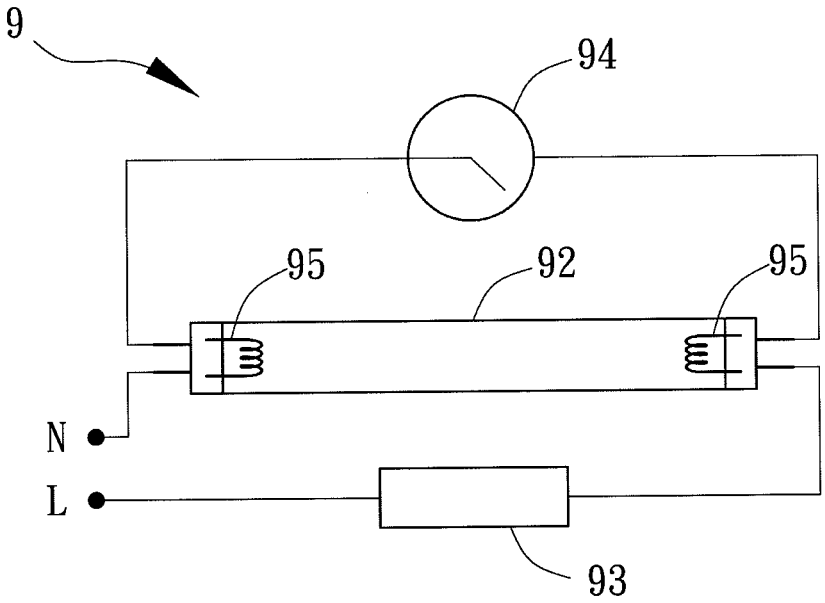
FIG. 1A (PRIOR ART)
FIG. 1A is a schematic view showing the connection configuration of a conventional fluorescent lamp.
Figure 1B:
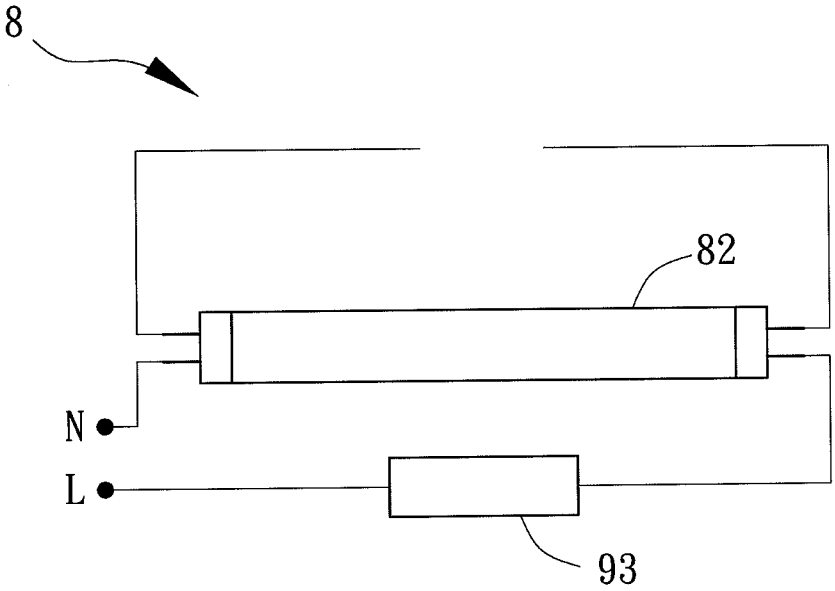
FIG. 1B (PRIOR ART)
FIG. 1B is a schematic view showing the connection configuration of a conventional light emitting diode lamp.
Figure 2C:
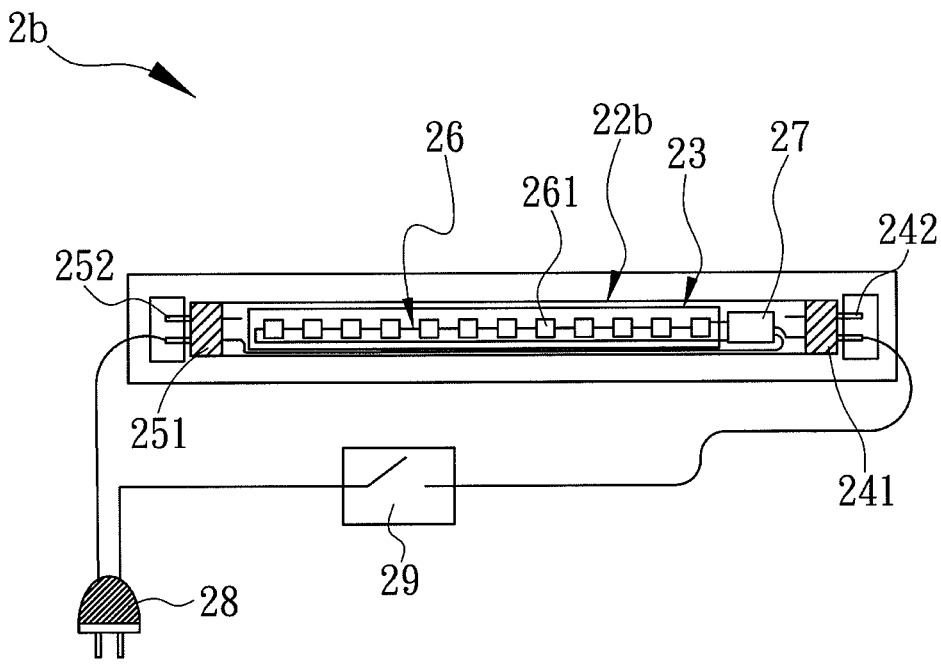
FIG. 2C is a schematic view of another variation of the lamp in FIG. 2A.

FIG. 2C is a schematic view of another variation of the lamp in FIG. 2A. The light emitting diode tube 22*b* of the lamp 2*b* includes at least one first conductive terminal 242 and at least one second conductive terminal 252. One end of each of the two conductive lines is connected to the plug 28, and the other ends thereof are electrically connected to the first conductive terminal 242 and the second conductive terminal 252, respectively. The alternative current power is applied to the light emitting diode tube 22*b* via the first conductive terminal 242 and the second conductive terminal 252. Moreover, the first conductive terminal 242 and the second conductive terminal 252 are electrically connected to two input ends of the driving unit 27, and two output ends of the driving unit 27 are electrically connected to the light emitting diode module 23. To be noted, the light emitting diode tube 22*b* can also be installed onto a conventional fluorescent lamp 9 without a starter (as shown in FIG. 1B).

Second Embodiment

Figure 5A:
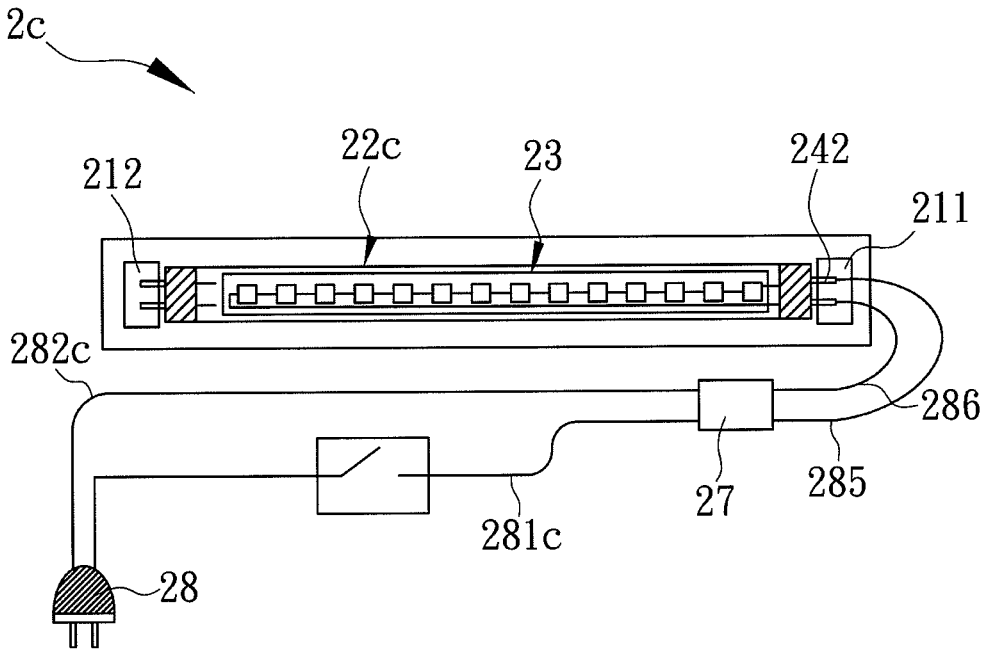
FIG. 5A is a schematic view of a lamp according to a second embodiment of the present invention.

FIG. 5A is a schematic view of a lamp 2*c* according to a second embodiment of the present invention. The lamp 2*c* is substantially identical with the lamp 2 of the first embodiment except that the driving unit 27 of the lamp 2*c* is disposed on a conductive line outside the tube holder 21 for converting the alternative current power to the direct current power, which is then inputted to a light emitting diode tube 22*c* via either the first terminal socket 211 or the second terminal socket 212 (FIG. 5A only shows the first terminal socket 211). The driving unit 27 is not disposed between the light emitting diode module 23 and the two first conductive terminals 242.

In more detailed, the lamp 2*c* of the present embodiment includes a first conductive line 281*c* and a second conductive line 282*c*. One end of the first conductive line 281*c* and one end of the second conductive line 282*c* are connected to the plug 28, and the other end of the first conductive line 281*c* and the other end of the second conductive line 282*c* are connected to the driving unit 27.

The lamp 2*c* further includes a fifth conductive line 285 and a sixth conductive line 286. One end of the fifth conductive line 285 and one end of the sixth conductive line 286 are connected to the driving unit 27, and the other end of the fifth conductive line 285 and the other one end of the sixth conductive line 286 are connected to the first terminal socket 211 for electrically connecting with the two first conductive terminals 242, respectively. The remaining parts of the lamp 2*c* are identical with the lamp 2 of the first embodiment, so the detailed description thereof will be omitted.

Figure 5B:
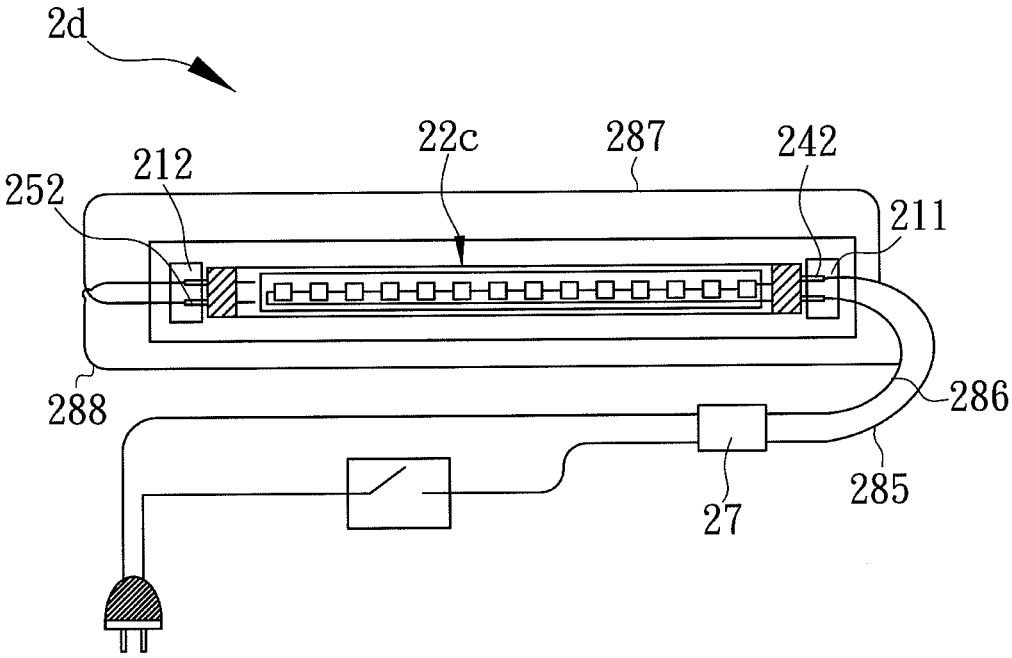
FIG. 5B is a schematic view of another variation of the lamp in FIG. 5A.

FIG. 5B is a schematic view of another variation of the lamp in FIG. 5A. The lamp 2*d* is substantially identical with the lamp 2*c* except the following features. The lamp 2*d* further includes a seventh conductive line 287 and an eighth conductive line 288. One end of the seventh conductive line 287 and one end of the eighth conductive line 288 are electrically connected to the fifth conductive line 285 and the sixth conductive line 286, respectively, and the other end of the seventh conductive line 287 and the other end of the eighth conductive line 288 are connected to the second terminal socket 212. Accordingly, the second terminal socket 212 and the first terminal socket 211 can be electrically connected to a direct current power source. The first conductive terminal 242 of the light emitting diode tube 22*b* can be conducted to the direct current power source via the first terminal socket 211 and the second terminal socket 212, thereby increasing the flexibility for installing the light emitting diode tube 22*d*. The remaining parts of the structure of the lamp 2*d* are identical with the lamp 2*c*, so the detailed description thereof will be omitted.

Figure 5C:
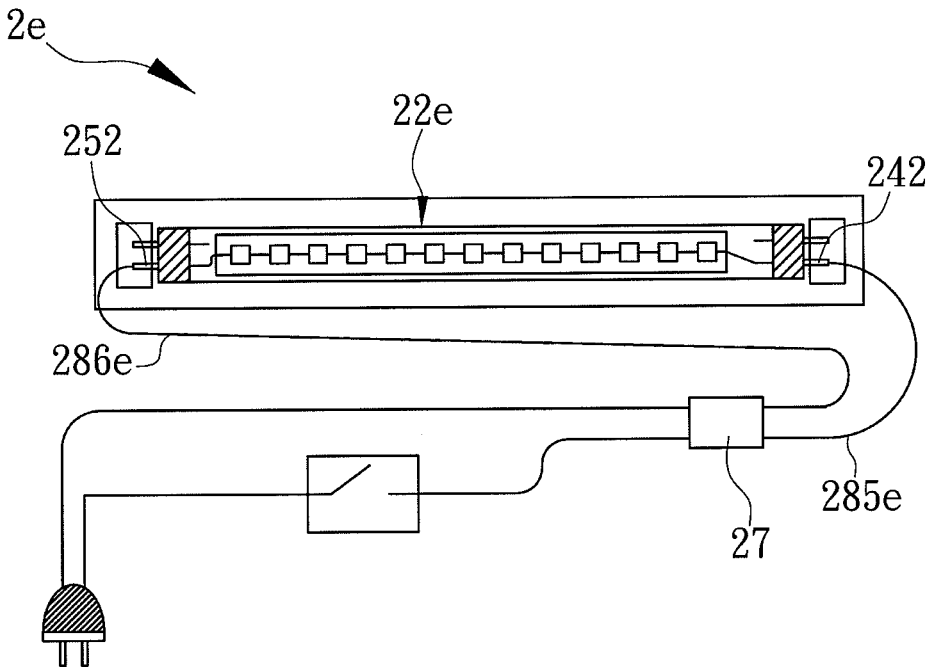
FIG. 5C is a schematic view of another variation of the lamp in FIG. 5A.

FIG. 5C is a schematic view of another variation of the lamp in FIG. 5A. The differences between the lamp 2*e* in FIG. 5C and the lamp 2*c* in FIG. 5A are described hereinafter. The light emitting diode tube 22*e* of the lamp 2*e* includes at least one first conductive terminal 242 and at least one second conductive terminal 252. The direct current power is conducted to the light emitting diode tube 22*e* via the first conductive terminal 242 and the second conductive terminal 252. In more detailed, one end of the fifth conductive line 285*e* and one end of the sixth conductive line 286*e* are connected to the driving unit 27, and the other end of the fifth conductive line 285*e* and the other end of the sixth conductive line 286*e* are electrically connected to the first conductive terminal 242 and the second conductive terminal 252, respectively. The detailed descriptions of the remaining parts will be omitted.

Third Embodiment

Figure 6A:
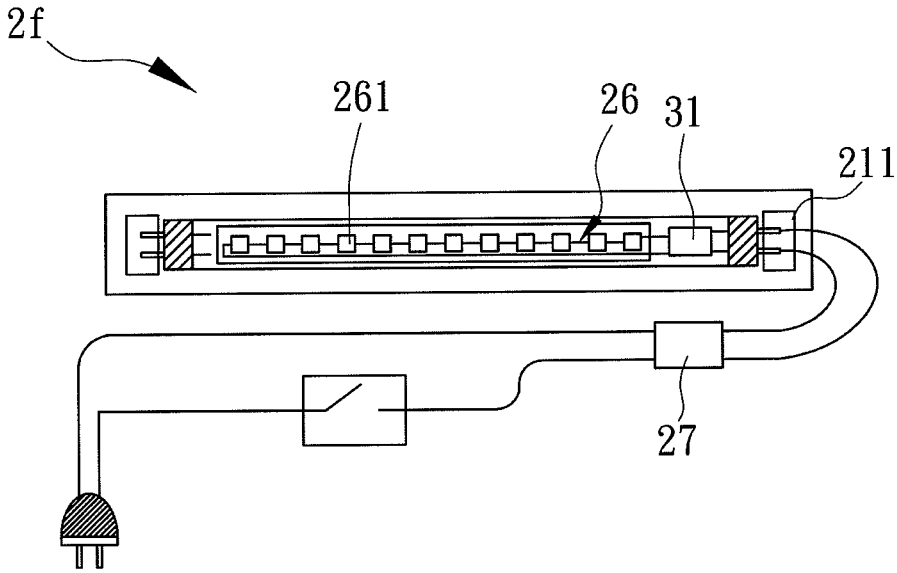
FIG. 6A is a schematic view of a lamp according to a third embodiment of the present invention.

FIG. 6A is a schematic view of a lamp 2*f* according to a third embodiment of the present invention. The lamp 2*f* is substantially identical with the lamp 2*c* of the second embodiment except the following features. The lamp 2*f* further includes a direct current to direct current converter 31 disposed between the first conductive terminal 242 and the light emitting diode module 23. The direct current to direct current converter 31 converts the alternative current power to the direct current power, and then the driving unit 27 provides appropriate current to the at least one light emitting diode string 26 to drive the light emitting diodes 261. The remaining parts of the lamp 2*f* are identical with the lamp 2*c* of the second embodiment, so the detailed description thereof will be omitted.

Figure 6B:
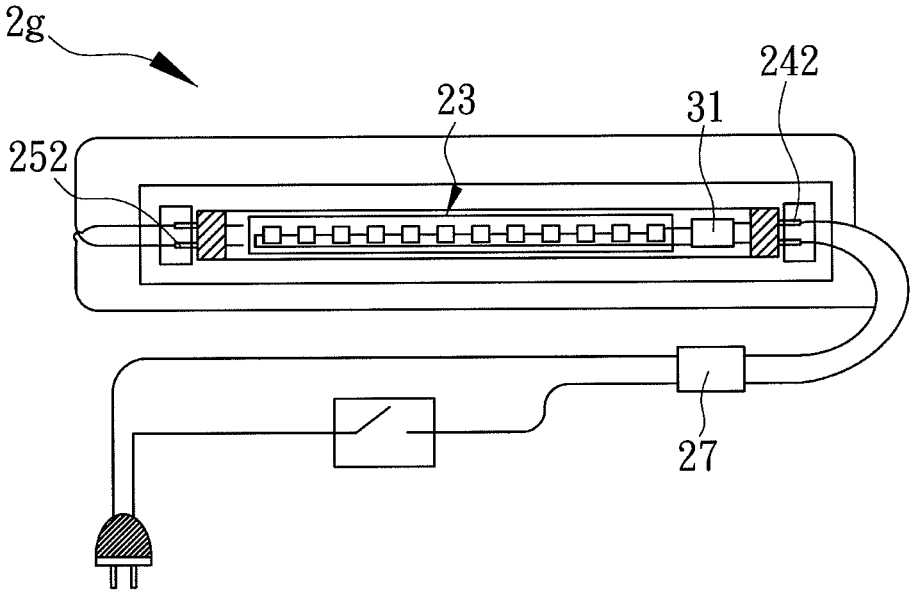
FIG. 6B is a schematic view of another variation of the lamp in FIG. 6A.

FIG. 6B is a schematic view of another variation of the lamp of the FIG. 6A. The lamp 2*g* is substantially identical with the lamp 2*d* except the following feature. The lamp 2*g* further includes a direct current to direct current converter 31 disposed between the first conductive terminal 242 and the light emitting diode module 23. The remaining parts of the lamp 2*g* are identical with the lamp 2*d* of the second embodiment, so the detailed description thereof will be omitted.

Figure 6C:
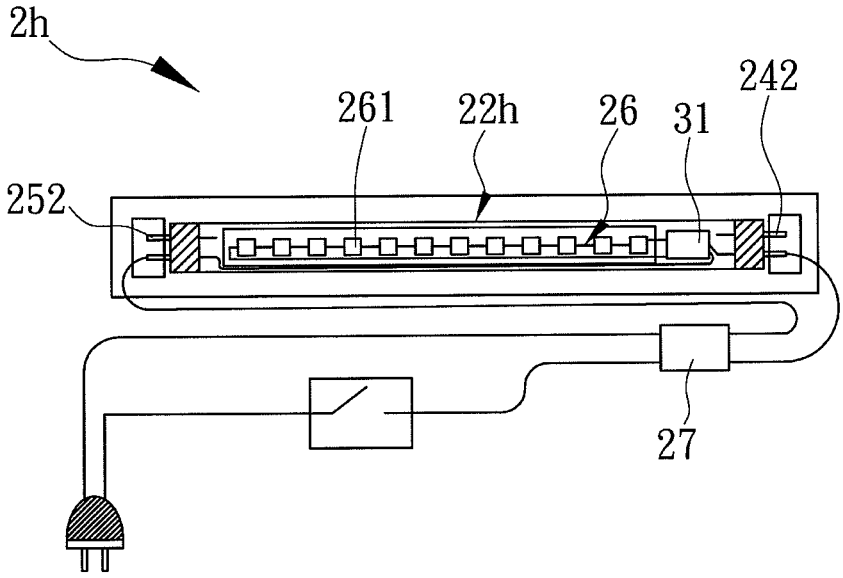
FIG. 6C is a schematic view of another variation of the lamp in FIG. 6A.

FIG. 6C is a schematic view of another variation of the lamp of FIG. 6A. The differences between the lamp 2*h* in FIG. 6C and the lamp 2*f* in FIG. 6A are described hereinafter. The light emitting diode tube 22*h* of the lamp 2*h* includes at least one first conductive terminal 242 and at least one second conductive terminal 252. The light emitting diode tube 22*h* is electrically connected to the direct current to direct current converter 31 via one of the first conductive terminals 242 and one of the second conductive terminals 252. Two input ends of the direct current to direct current converter 31 are electrically connected to one of the first conductive terminals 242 and one of the second conductive terminals 252, respectively, and two output ends of the direct current to direct current converter 31 are electrically connected to the light emitting diode module 23 to conduct the direct current power to the light emitting diode module 23. The detailed descriptions of the remaining parts of the lamp 2*h* will be omitted.

Fourth Embodiment

Figure 7:
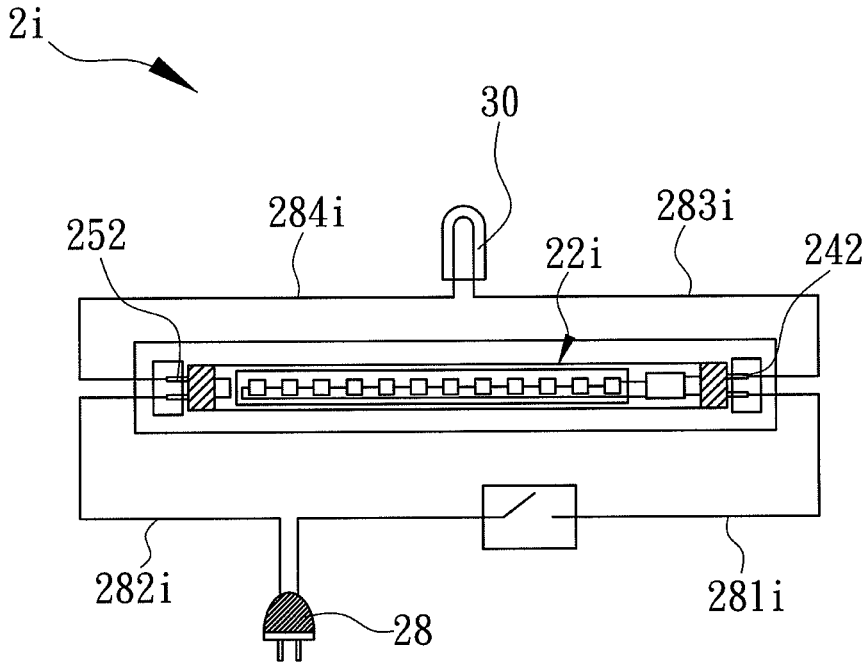
FIG. 7 is a schematic view of a lamp according to a fourth embodiment of the present invention.

FIG. 7 is a schematic view of a lamp 2*i* according to a fourth embodiment of the present invention. The structure of the lamp 2*i* is similar to the lamp 2 of the first embodiment except the following features.

The second conductive terminals 252 of the lamp 2*i* are shorted. One end of the first conductive line 281*i* and one end of the second conductive line 282*i* are connected to the plug 28, the other end of the first conductive line 281*i* is electrically connected to one of the first conductive terminals 242, and the other end of the second conductive line 282*i* is electrically connected to one of the second conductive terminals 252. The lamp 2*i* further includes a third conductive line 283*i*, a fourth conductive line 284*i*, and a short-circuit device 30. One end of the third conductive line 283*i* is electrically connected to the other one of the first conductive terminals 242, and one end of the fourth conductive line 284*i* is electrically connected to the other one of the second conductive terminals 252. The short-circuit device 30 is electrically connected to the other end of the third conductive line 283*i* and the other end of the fourth conductive line 284*i*, respectively, so as to short the third conductive line 283*i* and the fourth conductive line 284*i*. The lamp 2*i* can further include a ballast (not shown) disposed on the first conductive line 281*i*.

The light emitting diode tube 22*i* of the present embodiment can be successfully installed onto the conventional fluorescent lamp 9 after removing the starter 94 of the conventional fluorescent lamp 9 and installing the short-circuit device 30 to short the third conductive line 283*i* and the fourth conductive line 284*i*.

Fifth Embodiment

In this embodiment, the alternative current light emitting diodes are used instead of the direct current light emitting diodes, which are used in the first to fourth embodiments of the present invention. The difference among the lamp of the present embodiment and the lamps 2, 2*a*, and 2*b* of the first embodiment is in that the alternative current to direct current converter is not needed. The connection configuration of the lamp of the present embodiment can be similar to those of the three variations disclosed in the first embodiment, and there is no alternative current to direct current converter installed inside the light emitting diode tube. Therefore, the two first conductive terminals 242 at one end of the light emitting diode tube of the present embodiment are electrically connected to a Line wire and a Neutral wire, respectively. Alternatively, one of the first conductive terminals 242 and one of the second conductive terminals 252 are electrically connected to a Line wire and a Neutral wire, respectively, and the first conductive terminal 242 and the second conductive terminal 252 are further electrically connected to the light emitting diode module. The remaining parts of the lamp of the present embodiment are identical with either one of the lamps 2, 2*a* and 2*b* of the first embodiment, so the detailed descriptions thereof will be omitted.

In summary, the present invention provides types of lamps and light emitting diode tubes thereof. The light emitting diode tube can be electrically connected to a power source through its one end. Therefore, when the light emitting diode tube is unconsciously installed onto a conventional lamp, the light emitting diode can not be lighted. It is because the light emitting diode tube is electrically connected to the power source via two terminals of the first lamp cap mounted on one end of the light emitting diode tube, so that the safety can be enhanced.

The present invention also provides types of lamps and light emitting diode tubes thereof. The light emitting diode tube includes at least one first conductive terminal and at least one second conductive terminal. The first conductive terminal and the second conductive terminal conduct a direct current power or an alternative current power to the light emitting diode tube.

The present invention further provides a light emitting diode tube installed onto a conventional fluorescent lamp without a starter.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A lamp, comprising:

a tube holder comprising a first terminal socket and a second terminal socket, wherein the first terminal socket is electrically connected to a power source; and a light emitting diode tube installed on the tube holder, wherein one end of the light emitting diode tube comprises two first conductive terminals plugging in the first terminal socket, the light emitting diode tube comprises:

a light emitting diode module with at least one light emitting diode string, two second conductive terminals disposed on the other end of the light emitting diode module and plugging into the second terminal socket, wherein the two second conductive terminals are shorted;

a first conductive line;

a second conductive line, wherein one end of the first conductive line and one end of the second conductive line are electrically connected to the plug, the other end of the first conductive line is electrically connected to one of the first conductive terminals, and the other end of the second conductive line is electrically connected to one of the second conductive terminals;

a third conductive line;

a fourth conductive line; and a short-circuit device, wherein one end of the third conductive line is electrically connected to the other one of the first conductive terminals, one end of the fourth conductive line is electrically connected to the other one of the second conductive terminals, and the short-circuit device is connected with the other end of the third conductive line and the other end of the fourth conductive line so as to short the third conductive line and the fourth conductive line.

2. The lamp of claim 1, further comprising a ballast disposed on the first conductive line.

* * * * *